US006496143B1

(12) United States Patent
Vail et al.

(10) Patent No.: US 6,496,143 B1
(45) Date of Patent: Dec. 17, 2002

(54) PHASED ARRAY ANTENNA INCLUDING A MULTI-MODE ELEMENT CONTROLLER AND RELATED METHOD

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/991,534

(22) Filed: Nov. 9, 2001

(51) Int. Cl.[7] ..... H01Q 3/22; H01Q 3/24; H01Q 3/26

(52) U.S. Cl. ..... 342/372; 342/157

(58) Field of Search ..... 342/372, 157, 342/368

(56) References Cited

U.S. PATENT DOCUMENTS

| | | | | |
|---|---|---|---|---|
| 4,931,803 A | | 6/1990 | Shimko | 342/371 |
| 4,980,691 A | | 12/1990 | Rigg et al. | 342/372 |
| 4,994,814 A | | 2/1991 | Aoki et al. | 342/372 |
| 4,996,532 A | | 2/1991 | Kirimoto et al. | 342/81 |
| 5,008,680 A | | 4/1991 | Willey et al. | 342/372 |
| 5,027,126 A | | 6/1991 | Basehgi et al. | 342/372 |
| 5,072,228 A | | 12/1991 | Kuwahara | 342/360 |
| 5,225,841 A | | 7/1993 | Krikorian et al. | 342/204 |
| 5,231,405 A | | 7/1993 | Riza | 342/375 |
| 5,243,274 A | | 9/1993 | Kelsey et al. | 324/158 R |
| 5,283,587 A | | 2/1994 | Hirshfield et al. | 342/372 |
| 5,353,031 A | | 10/1994 | Rathi | 342/372 |
| 5,414,433 A | * | 5/1995 | Chang | 342/375 |
| 5,471,220 A | * | 11/1995 | Hammers et al. | 342/372 |
| 5,493,255 A | | 2/1996 | Murtojarvi | 330/296 |
| 5,559,519 A | | 9/1996 | Fenner | 342/174 |
| 5,592,178 A | * | 1/1997 | Chang et al. | 342/372 |
| 5,592,179 A | | 1/1997 | Windyka | 342/372 |
| 5,655,841 A | | 8/1997 | Storm | 374/183 |
| 5,680,141 A | | 10/1997 | Didomenico et al. | 342/372 |
| 5,771,016 A | | 6/1998 | Mullins et al. | 342/372 |
| 5,938,779 A | | 8/1999 | Preston | 714/718 |
| 5,990,830 A | | 11/1999 | Vail et al. | 342/368 |
| 5,995,740 A | | 11/1999 | Johnson | 395/500.41 |
| 5,999,990 A | | 12/1999 | Sharrit et al. | 718/8 |
| 6,011,512 A | | 1/2000 | Cohen | 342/372 |
| 6,023,742 A | | 2/2000 | Ebeling et al. | 710/107 |
| 6,157,681 A | | 12/2000 | Daniel et al. | 375/298 |
| 6,163,220 A | | 12/2000 | Schellenberg | 330/295 |
| 6,172,642 B1 | | 1/2001 | DiDomenico et al. | 342/368 |

* cited by examiner

*Primary Examiner*—Theodore M. Blum
(74) *Attorney, Agent, or Firm*—Allen, Dyer, Doppelt, Milbrath & Gilchrist, P.A.

(57) ABSTRACT

A phased array antenna may include a substrate and a plurality of controllable phased array antenna elements carried thereby, a central controller for generating a mode selection signal and beam control signals, and at least one multi-mode element controller connected to at least one of the controllable phased array antenna elements and the central controller. The at least one multi-mode element controller may be operable in a desired operating mode from among a plurality of operating modes based upon the mode selection signal from the central controller. Furthermore, the at least one multi-mode element controller may also generate output signals for the at least one controllable phased array antenna element based upon the beam control signals from the central controller.

30 Claims, 3 Drawing Sheets

PHASED ARRAY ANTENNA INCLUDING A MULTI-MODE ELEMENT CONTROLLER AND RELATED METHOD

FIELD OF THE INVENTION

The present invention relates to the field of communications, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping" or "spoiling") or direction (i.e., "beam steering") of the communications signals in response to the signal environment to improve performance characteristics.

A typical phased array antenna may include, for example, one or more element controllers connected to a central controller. Among other functions, the element controllers process beam control signals generated by the central controller (e.g., beam steering signals and/or beam spoiling signals) and provide output control signals for each of the phased array antenna elements. More particularly, each antenna element may have a controllable device associated therewith (e.g., a phase shifter, attenuator, and/or delay generator), and the output control signals may be used to control a phase, attenuation, or delay thereof. Thus, the transmission or reception pattern may be varied, as noted above.

Phased array antenna designs can vary widely due to the numerous environments and applications in which they are used. As a result, the design of various components used in phased array antennas may also vary widely from one antenna to the next. This is particularly true of element controllers, which are typically designed to perform very specific element control functions based upon the intended use of the antenna. Thus, a common prior art approach is to implement element controllers in application specific integrated circuits (ASICs), which, as the name implies, are designed for one particular antenna application.

A drawback of this approach is that even slight changes in system requirements may dictate the use of different ASIC element controllers from one antenna to the next. Yet, the design and testing of an ASIC can be both expensive and time consuming.

Attempts have been made in the prior art to provide more "universal" communications equipment that is adaptable to changing system requirements. One example is disclosed in U.S. Pat. No. 5,999,990 to Sharrit et al. entitled "Communicator Having Reconfigurable Resources." The communicator is for use in a communications system, such as in a base station or hand held transceiver unit, and includes a plurality of reconfigurable resource units (RRUs) that can each be dynamically altered to perform different processing tasks. A controller determines the processing tasks to be supported by the communicator and configures the RRUs accordingly. More particularly, the communicator determines if one of the RRUs is already configured to perform a desired processing task. If not, the controller obtains the necessary configuration file for the desired task and determines an amount of resources required by the configuration file as well as RRU availability to determine which RRU(s) will perform the desired task.

While such a communicator may provide certain advantages when used in a base station, it may not be well suited for use as an individual element controller. One reason is that it may require a relatively large amount of processing capability as well as memory space to implement, which may not be practical in an element control ASIC because of cost and power constraints. This problem would become particularly acute in phased array antennas including numerous phased array antenna elements and a respective element control ASIC for each element.

SUMMARY OF THE INVENTION

In view of the foregoing background, it is therefore an object of the present invention to provide a phased array antenna including one or more element controllers that may be operated in multiple operating modes.

This and other objects, features, and advantages in accordance with the present invention are provided by a phased array antenna which may include a substrate and a plurality of controllable phased array antenna elements carried thereby, a central controller for providing a mode selection signal and beam control signals, and at least one multi-mode element controller connected to at least one of the controllable phased array antenna elements and the central controller. The at least one multi-mode element controller may be operable in a desired operating mode from among a plurality of operating modes based upon the mode selection signal from the central controller. Furthermore, the at least one multi-mode element controller may also generate output signals for the at least one controllable phased array antenna element based upon the beam control signals from the central controller. By having a plurality of operating modes, the multi-mode element controller may advantageously be used in numerous phased array antennas.

More particularly, the at least one multi-mode element controller may include a memory for storing temperature compensation data or other element calibration, and a processor cooperating with the memory for generating the output signals based upon the beam control signals and the temperature compensation data. The output signals may be digital output signals, for example, and the at least one multi-mode element controller may define a number of bits for the digital output signals based upon the mode selection signal. For example, automatic rounding can be set according to the variable number of output control bits.

The phased array antenna may also include a controllable device connected between the at least one multi-mode element controller and the at least one controllable phased array antenna element for controlling at least one of a phase, attenuation, and delay based upon the output signals. Further, the plurality of operating modes may include a phase control operating mode, an attenuation control operating mode, and a delay control operating mode. In addition, the beam control signals may be beam steering signals and/or beam spoiling signals, for example.

The at least one multi-mode element controller may also include an output register for storing and outputting the output signals, and a bus interface for receiving the mode selection signal and beam control signals from the central controller. Additionally, the at least one multi-mode element controller may be implemented in an application specific integrated circuit (ASIC), for example.

A multi-mode element controller for a controllable phased array antenna element is also provided according to the present invention and may include an interface for receiving a mode selection signal and beam control signals from a central controller and a processor coupled to the interface. The processor may be operable in a desired operating mode from among a plurality of operating modes based upon the mode selection signal, and the processor may generate output signals for the controllable phased array antenna element based upon the beam control signals.

A method aspect of the invention is for controlling a phased array antenna element using a multi-mode element controller. The method may include generating a mode selection signal and beam control signals, selecting a desired operating mode for the multi-mode element controller from among a plurality of operating modes based upon the mode selection signal, and generating output signals for the at least one controllable phased array antenna element using the multi-mode element controller based upon the beam control signals.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
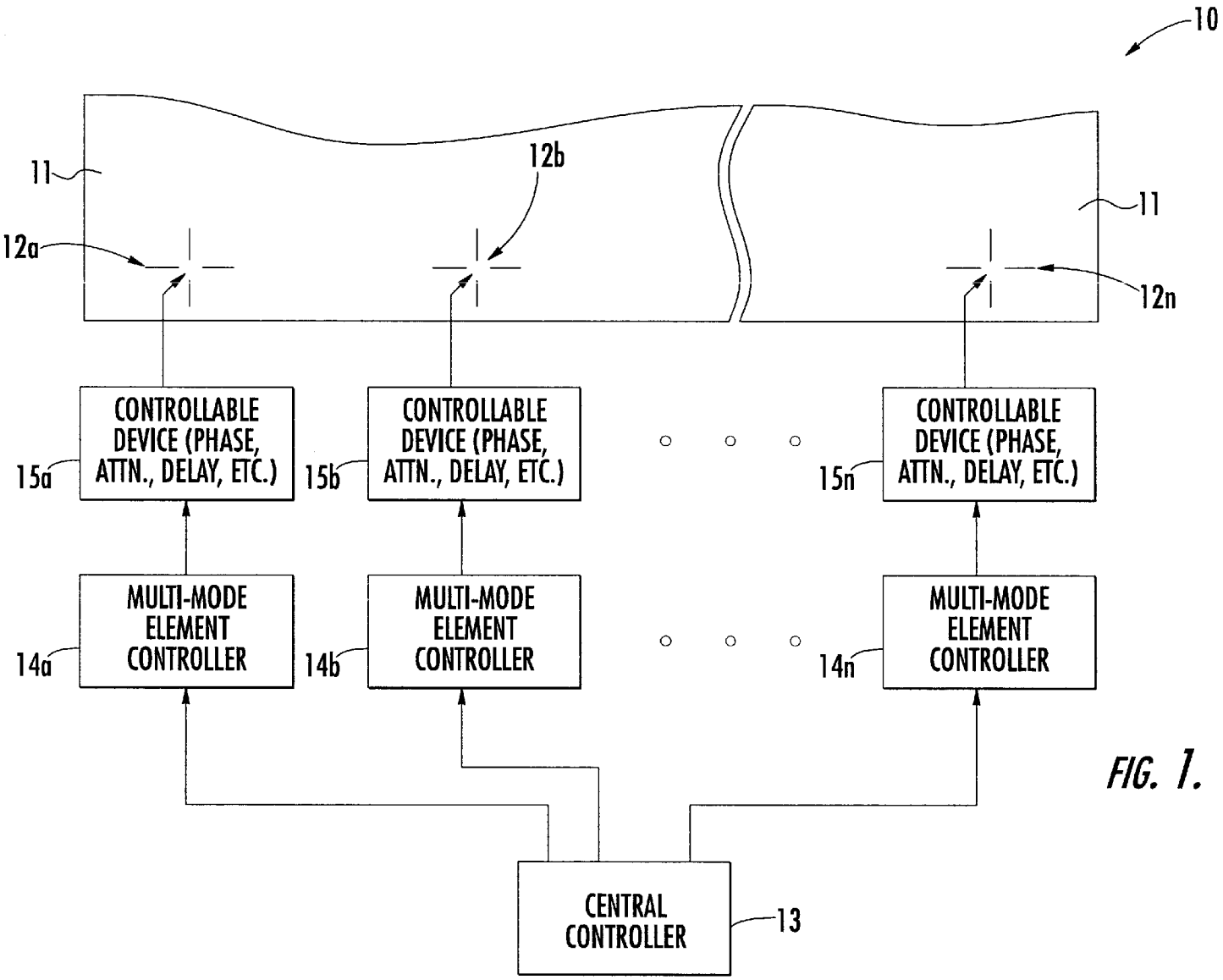
FIG. 1 is schematic block diagram of a phased array antenna according to the present invention.

Referring initially to FIG. 1, a phased array antenna 10 according to the invention will now be described. The phased array antenna 10 may be used for ground, airborne, or spaceborne applications, as will be readily understood by those skilled in the art. As illustrated in FIG. 1, the phased array antenna 10 includes a substrate 11 and a plurality of phased array antenna elements 12*a*–12*n* carried thereby. As used herein, "substrate" refers to any surface, mechanized structure, etc., which is suitable for carrying a phased array antenna element, as will be appreciated by those of skill in the art. The phased array antenna 10 also illustratively includes a central controller 13 for providing a mode selection signal and beam control signals. For example, the central controller 13 may translate commands from a host (not shown) and provide the mode selection signal and beam control signal based upon the host commands. The beam control signals may be beam spoiling signals and/or beam steering signals, for example, as will be understood by those skilled in the art.

The phased array antenna 10 further includes one or more multi-mode element controllers 14*a*–14*n*. As illustrated in FIG. 1, each of the multi-mode element controllers 14*a*–14*n* may be connected to a respective controllable phased array antenna element 12*a*–12*n*. Yet, in some embodiments a single multi-mode element controller may be used to control more than one controllable phased array antenna element, as will be appreciated by those of skill in the art.

Each multi-mode element controller 14*a*–14*n* is operable in a desired operating mode from among a plurality of operating modes based upon one or more mode selection signals from the central controller 13. More particularly, the operating modes may include a phase control operating mode, an attenuation control operating mode, a delay control operating mode, etc. Once the desired operating mode of the multi-mode element controllers 14*a*–14*n* are set by the mode selection signal, each multi-mode element controller may be used to generate output signals for its respective controllable phased array antenna element 12*a*–12*n* based upon the beam control signals from the central controller 13. By way of example, the mode selection signal may be provided by the central controller 13 upon initialization of the phased array antenna 10.

More particularly, a respective controllable device 15*a*–15*n* may be connected between each multi-mode element controller 14*a*–14*n* and its associated controllable phased array antenna element 12*a*–12*n*. The controllable devices 15*a*–15*n* may each include one or more of a phase shifter, an attenuator, and a delay generator, for example. As will be appreciated by those of skill in the art, the controllable devices 15*a*–15*n* may cooperate with transmitters/receivers (e.g., microwave, RF, etc.) of the phased array antenna element 10 (not shown for clarity of illustration) to control any one or more of a phase, attenuation, and delay based upon respective output signals.

It will therefore be appreciated by those of skill in the art that since the multi-mode element controllers 14*a*–14*n* may operate in one of a plurality of operating modes, these multi-mode element controllers may advantageously be used in many different phased array antennas. For example, if a particular phased array antenna only includes phase shifters for the controllable phased array antenna elements 12*a*–12*n*, the multi-mode element controllers 14*a*–14*n* would simply require an initialization mode selection signal to operate in the phase control operating mode.

The same multi-mode element controllers 14*a*–14*n* could just as easily be implemented in a phased array antenna including attenuators and delay generators. That is, the central controller 13 would simply need to be programmed to send an attenuation mode operating signal or a delay control operating mode signal prior to sending beam control signals to be processed in the given mode. As will be appreciated, the multi-mode element controllers 14*a*–14*n* according to the present invention thus serve as a "universal" element controllers. Thus, the need to re-design and build an ASIC, re-program a field-programmable gate array, etc., may be avoided for many new phased array antenna designs. This may not only result in reduced design time and expense, but it may also alleviate the need for stocking numerous replacement parts for multiple phased array antennas.

Figure 2:
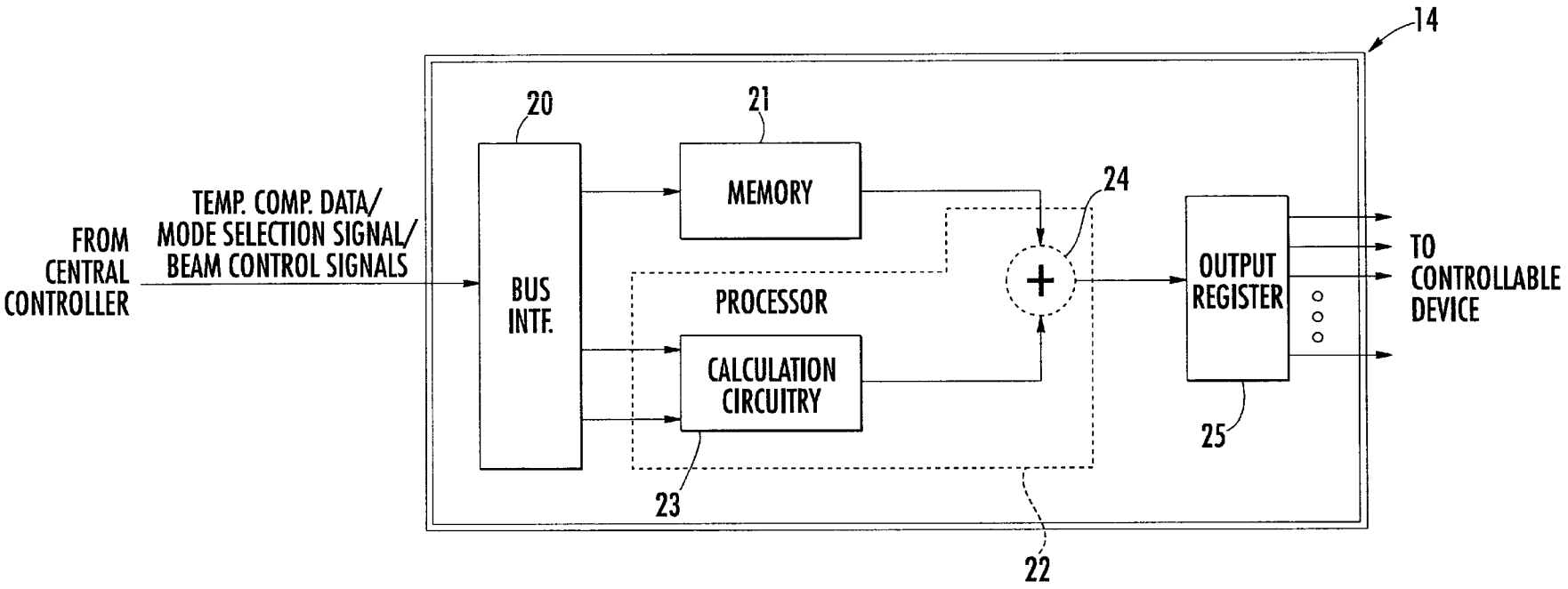
FIG. 2 is a more detailed schematic block diagram of one of the multi-mode element controllers of FIG. 1.

Turning now additionally to FIG. 2, the multi-mode element controller 14 of the present invention will now be described in further detail. As illustratively shown, the multi-mode element controller 14 includes a bus interface 20 for receiving the mode selection signal and beam control signals from the central controller 13. The bus connecting the central controller 13 and multi-mode element controller 14 may be a serial bus as illustratively shown, or other suitable bus (e.g., parallel bus). In some embodiments, the multi-mode element controller 14 may include a memory 21 for storing element compensation data, such as temperature compensation data, provided by the central controller 13, for example, as will be appreciated by those of skill in the art. The memory 21 could be on-chip for quick local lookup of temperature compensation for fast-changing variables for a specific temperature range, for example. The memory 21 may be updated when the temperature changes to a value outside this range. For applications without fast-changing variables, only a single temperature composition value may be needed.

The multi-mode element controller 14 also illustratively includes a processor 22 (shown with dashed lines) which may cooperate with the memory 21 to generate the output signals based upon the beam control signals and the temperature compensation data. More particularly, the processor 22 may be thought of in conceptual terms as calculation circuitry 23 for processing the beam control signals and an adder 24 for adding the processed beam control signals to the temperature compensation data, if required. The multi-mode element controller also illustratively includes one (or more) output registers 25 for storing and outputting the output signals. Of course, those of skill in the art will appreciate that the memory 21 and output register 25 may also be included within the processor 22, for example, and that other configurations are also possible.

The multi-mode element controller 14 may advantageously be implemented in an application specific integrated circuit (ASIC), for example, such as a digital ASIC. In such an embodiment, the output signals will be digital output signals. Another advantageous feature of the multi-mode element controller 14 is that the processor 22 may define a number of bits for the digital output signals, which may be done based upon the mode selection signal. By way of example, the multi-mode element controller 14 may have a fixed number of bits (e.g., 8), and only the bits needed are connected and used (e.g., 4 bits may be used to control a typical phase shifter). However, rounding the output result to the correct number of bits could also be a programmable initialization feature in some embodiments, as will be appreciated by those of skill in the art.

More particularly, in some embodiments it may be assumed that the phased array antenna 10 will always include a control device 15 (e.g., phase shifter) with a predetermined number of digital control input bits. Thus, the processor 22 may be configured such that when it receives a particular mode selection signal (e.g., a phase control operation mode signal) it will always provide output signals having the predetermined number of bits, as described above. Alternately, a first mode selection signal could be sent to set the desired operating mode of the processor 22, and then another mode selection signal could be sent to instruct the processor as to how many output bits to use. Various other alternatives are also possible, as will be appreciated by those skilled in the art.

Figure 3:
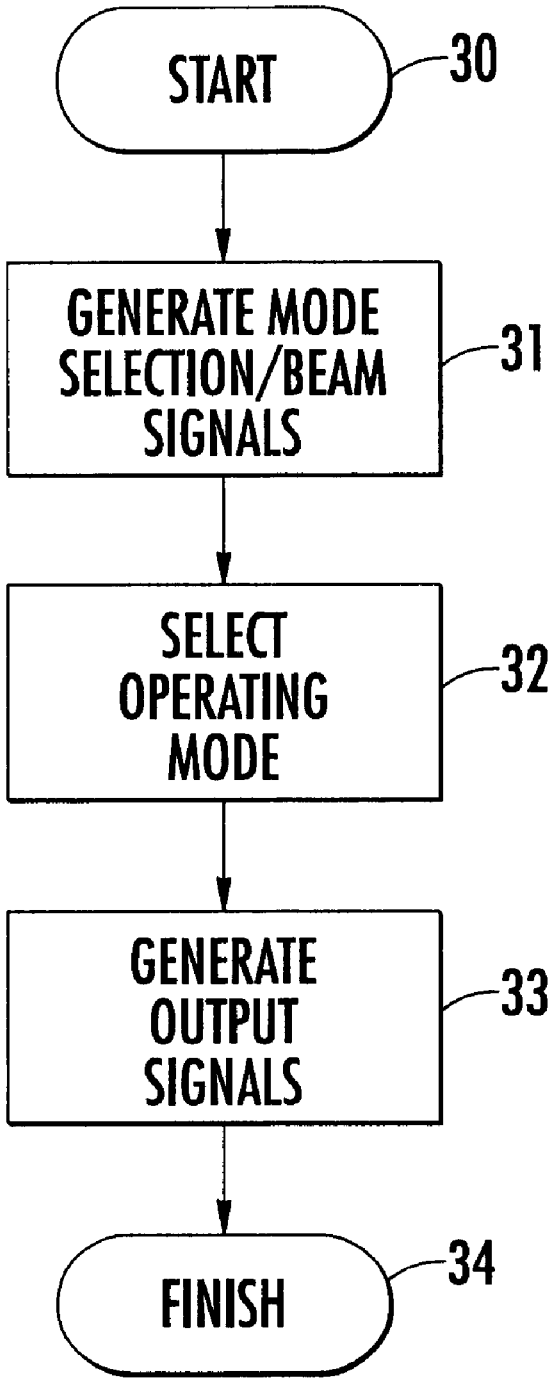
FIG. 3 is a flow diagram of a method according to the present invention.

A method aspect of the invention for controlling a phased array antenna element 12 using the multi-mode element controller 14 will now be described with reference to the flow diagram of FIG. 3. The method begins (Block 30) by generating a mode selection signal and beam control signals, at Block 31. As noted above, the central controller 13 may generate these signals and send them to the multi-mode element controller 14 at substantially the same time. A desired operating mode for the multi-mode element controller 14 is then selected from among a plurality of operating modes based upon the mode selection signal, at Block 32. In some embodiments, the beam control signals may be generated and sent to the multi-mode element controller 14 after the mode has been selected, if desired.

Furthermore, the method also illustratively includes generating output signals for the controllable phased array antenna element 12 using the multi-mode element controller 14 (as previously described above) based upon the beam control signals, at Block 33, thus ending the method (Block 34). Other aspects of the method follow from the above description and will therefore not be discussed further herein for clarity of explanation.

Some additional aspects of the invention are as follows. First, each element controller 14 can be initialized with values which depend both on the element controller function (i.e., element phase control or attenuator control), and with values which depend on the relative position of the antenna element 12 in the array. This is typically done by utilizing the row/column addressing of the element controllers 14. Once this initialization is complete, each element controller 14 can compute different outputs, even with a common broadcast command. For example, the central controller 13 could broadcast x and y phase gradients, and each element controller 14 could calculate its own phase control value to steer the phased array antenna beam.

Additionally, the use of a register file and multiplier within the element controller processor 22 allows efficient calculation of beam steering, beam spoiling, or both. The same processor 22 can be used to control an attenuator or delay generator simply by initializing the register file values to zero. Furthermore, by organizing each element controller 14 to be a type of "special purpose processor," the central controller 13 can issue commands in an order and type to be customizable for different phased array configurations. The processor 22 instruction set would include commands to multiply and/or accumulate using constant register file data and new (phase gradient) data, register read/write, register-to-register data transfers, etc.

The multi-mode element controller 14 could also be implemented as a "macrocell" within an ASIC or FPGA. Macrocell parameters could specify customizing aspects such as the amount of lookup RAM, data path width, number of output channels, etc., as will be appreciated by those of skill in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of controllable phased array antenna elements carried thereby;

a central controller for providing a mode selection signal and beam control signals; and at least one multi-mode element controller connected to at least one of said controllable phased array antenna elements and said central controller, said at least one multi-mode element controller being switchable between a plurality of operating modes comprising at least a phase control operating mode and an attenuation control operating mode based upon the mode selection signal from said central controller;

said at least one multi-mode element controller also generating output signals for said at least one controllable phased array antenna element based upon the beam control signals from said central controller.

2. The phased array antenna of claim 1 wherein said at least one multi-mode element controller comprises:

a memory for storing temperature compensation data; and a processor cooperating with said memory for generating the output signals based upon the beam control signals and the temperature compensation data.

3. The phased array antenna of claim 1 wherein the output signals comprise digital output signals, and wherein said at least one multi-mode element controller defines a number of bits for the digital output signals based upon the mode selection signal.

4. The phased array antenna of claim 1 further comprising a controllable device connected between said at least one multi-mode element controller and said at least one controllable phased array antenna element for controlling at least one of a phase, attenuation, and delay based upon the output signals.

5. The phased array antenna of claim 1 wherein the plurality of operating modes further comprises a delay control operating mode.

6. The phased array antenna of claim 1 wherein the beam control signals comprise beam steering signals.

7. The phased array antenna of claim 1 wherein the beam control signal comprise beam spoiling signals.

8. The phased array antenna of claim 1 wherein said at least one multi-mode element controller comprises an output register for storing and outputting the output signals.

9. The phased array antenna of claim 1 wherein said at least one multi-mode element controller comprises a bus interface for receiving the mode selection signal and beam control signals from said central controller.

10. The phased array antenna of claim 1 wherein said at least one multi-mode element controller is implemented in an application specific integrated circuit (ASIC).

11. A phased array antenna comprising:

a substrate and a plurality of controllable phased array antenna elements carried thereby;

a central controller for providing a mode selection signal and beam control signals; and a respective multi-mode element controller connected to each of said controllable phased array antenna elements and said central controller, said multi-mode element controller being switchable between a plurality of operating modes comprising at least a phase control operating mode, an attenuation control operating mode, and a delay control operating mode based upon the mode selection signal from said central controller;

each multi-mode element controller also generating output signals for a respective controllable phased array antenna element based upon the beam control signals from said central controller.

12. The phased array antenna of claim 11 wherein each multi-mode element controller comprises:

a memory for storing temperature compensation data; and a processor cooperating with said memory for generating the output signals based upon the beam control signals and the temperature compensation data.

13. The phased array antenna of claim 11 wherein the output signals comprise digital output signals, and wherein each multi-mode element controller defines a number of bits for the digital output signals based upon the mode selection signal.

14. The phased array antenna of claim 11 further comprising a controllable device connected between each multi-mode element controller and a respective controllable phased array antenna element for controlling at least one of a phase, attenuation, and delay based upon the output signals.

15. The phased array antenna of claim 11 wherein the beam control signals comprise beam steering commands.

16. The phased array antenna of claim 11 wherein the beam control signals comprise beam spoiling signals.

17. The phased array antenna of claim 11 wherein each multi-mode element controller comprises an output register for storing and outputting the output signals.

18. The phased array antenna of claim 11 wherein each multi-mode element controller comprises a bus interface for receiving the mode selection signal and beam control signals from said central controller.

19. The phased array antenna of claim 11 wherein each multi-mode element controller is implemented in an application specific integrated circuit (ASIC).

20. A multi-mode element controller for a controllable phased array antenna element comprising:

an interface for receiving a mode selection signal and beam control signals from a central controller; and a processor coupled to said interface and being switchable between a plurality of operating modes comprising at least a phase control operating mode and an attenuation control operating mode based upon the mode selection signal, said processor for generating output signals for the controllable phased array antenna element based upon the beam control signals.

21. The multi-mode element controller of claim 20 further comprising a memory for storing temperature compensation data, and wherein said processor cooperates with said memory to generate the output signals based upon the beam control signals and the temperature compensation data.

22. The multi-mode element controller of claim 20 wherein the output signals comprise digital output signals, and wherein said processor defines a number of bits for the digital output signals based upon the mode selection signal.

23. The multi-mode element controller of claim 20 wherein the plurality of operating modes further comprises a delay control operating mode.

24. The multi-mode element controller of claim 20 wherein the beam control signals comprise at least one of beam steering commands and beam spoiling signals.

25. The multi-mode element controller of claim 20 further comprising an output register for storing and outputting the output signals.

26. A method for controlling a phased array antenna element using a multi-mode element controller comprising:

providing a mode selection signal and beam control signals;

selecting a desired operating mode for the multi-mode element controller from among a plurality of operating modes comprising at least a phase control operating mode and an attenuation control operating mode based upon the mode selection signal; and generating output signals for the at least one controllable phased array antenna element using the multi-mode element controller based upon the beam control signals.

27. The method of claim 26 wherein generating the output signals further comprises generating the output signals based upon the beam control signals and temperature compensation data.

28. The method of claim 26 wherein the output signals comprise digital output signals, and wherein the at least one multi-mode element controller defines a number of bits for the digital output signals based upon the mode selection signal.

29. The method of claim 26 wherein the plurality of operating modes further comprises a delay control operating mode.

30. The method of claim 26 wherein the beam control signals comprise at least one of beam steering commands and beam spoiling signals.

* * * * *